US005452366A

United States Patent [19]

Sakamoto et al.

[11] Patent Number: 5,452,366

[45] Date of Patent: Sep. 19, 1995

[54] LOUDSPEAKER

[75] Inventors: Yoshio Sakamoto, Hachioji; Hiroyuki Kumakura, Choufu, both of Japan

[73] Assignee: Kabushiki Kaisha Kenwood, Tokyo, Japan

[21] Appl. No.: 189,174

[22] Filed: Jan. 31, 1994

[30] Foreign Application Priority Data

Feb. 2, 1993 [JP] Japan ..... 5-037489

[51] Int. Cl.[6] ..... H04R 25/00

[52] U.S. Cl. ..... 381/199; 381/204; 381/201; 381/188; 381/205

[58] Field of Search ..... 381/199, 192, 205, 204, 381/201; 335/213, 215, 229, 296, 297, 302, 306

[56] References Cited

U.S. PATENT DOCUMENTS 3,067,366 12/1962 Hufman ..... 381/201

FOREIGN PATENT DOCUMENTS 0503860 9/1992 European Pat. Off. .
3730305 9/1987 Germany .
0075999 5/1983 Japan ..... 381/192
1550924 8/1979 United Kingdom .

*Primary Examiner*—Curtis Kuntz
*Assistant Examiner*—Sinh Tran
*Attorney, Agent, or Firm*—Sixbey, Friedman, Leedom & Ferguson

[57] ABSTRACT

A loudspeaker having a repulsion magnetic circuit capable of suppressing negative magnetic fluxes. The loudspeaker has magnets with the same poles being faced each other and an outer magnet magnetized in a direction different from the counter magnets is disposed outside of the counter magnets. A voice coil containing magnetic material is disposed outside of a magnet magnetized in a radial direction from the inner wall to the outer wall of the magnet, or outside of a magnet assembled by magnet pieces magnetized in a predetermined direction and arranged to take the same magnetization direction.

4 Claims, 10 Drawing Sheets

FIG. 7A
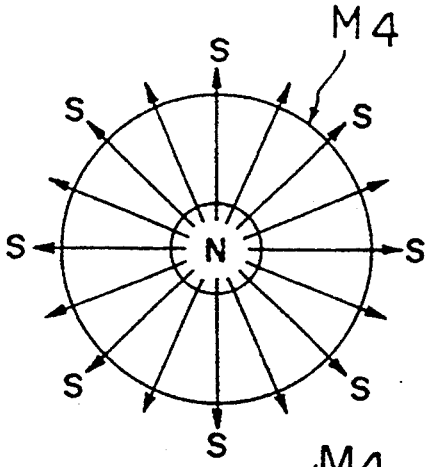
FIG. 7B
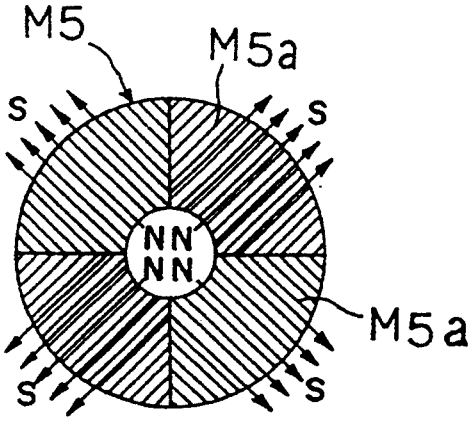
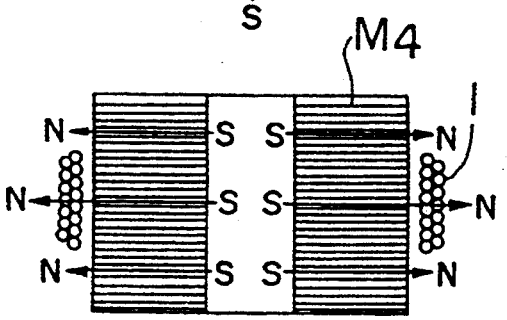
FIG. 7C
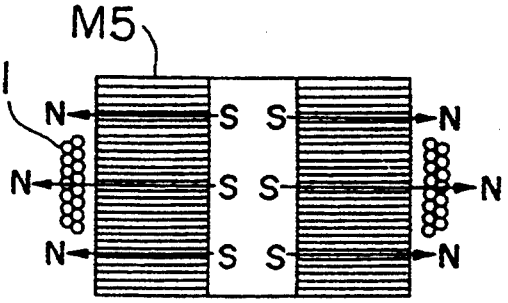
FIG. 7D

LOUDSPEAKER

BACKGROUND OF THE INVENTION

1. Field of the Invention

The present invention relates to a moving coil type loudspeaker, and more particularly to a loudspeaker in which two magnets are disposed with the same poles being faced each other and a voice coil is disposed in a repulsion magnetic field generated by the magnets.

2. Related Background Art

Various types of loudspeakers have been proposed heretofore, in which two magnets are disposed with the same poles being faced each other and a voice coil is disposed in a repulsion magnetic field generated by the magnets (for example, refer to Japanese Patent Laid-open Publications Nos. 59-148500 and 1-98400). One example of such loudspeakers is shown in FIG. 10. Two magnets M1 and M2 magnetized in the thickness direction are disposed with the same poles being faced each other, and a center plate P is sandwiched between the magnets. A tape or the like made of magnetic material F such as amorphous material is wound on the outer circumference of a voice coil 1 wound with a coil made of conductive material C such as copper. This voice coil 1 is disposed spaced apart from the magnets M1 and M2 by a predetermined distance.

Not only a coil but also an amorphous metal tape is required for the voice coil 1 shown in FIG. 10. Therefore, the number of components increases. Furthermore, an amorphous metal tape is difficult to obtain and is expensive more than soft magnetic material such as iron and Permalloy. An amorphous metal tape has generally a high elastic modulus so that it is difficult to curl it and make it match the outer circumferential shape of the voice coil 1.

In order to solve the above problems, the prevent inventors have proposed a loudspeaker such as shown in FIG. 8. In this loudspeaker, two magnets M1 and M2 magnetized in the thickness direction are disposed with the same poles being faced each other, and a center plate P of a disk type made of iron is sandwiched between the magnets. An outer ring L made of soft magnetic material F such as iron is disposed outside of the center plate P, with a predetermined magnetic gap G being formed between the outer circumference of the center plate P and the inner circumference of the outer ring L. A voice coil 1 is disposed in the magnetic gap G.

The present inventors have also proposed a loudspeaker such as shown in FIG. 9 in which the outer ring L is not used but a voice coil 1 is wound with a coil containing magnetic material. For example, the coil may have a core of soft magnetic material F such as iron and a surface layer of conductive material C such as copper and aluminum which is adhered to the surface of the core by means of plating, pressure attaching, or vapor deposition, or it may have a core of conductive material C such as copper and aluminum and a surface layer of soft magnetic material F such as iron and Permalloy which is adhered to the surface of the core by means of plating or vapor deposition.

The magnetic flux distribution of a magnetic circuit in the repulsion magnetic field will first be described. Repulsive magnetic fluxes flow from the magnets M1 and M2 whose same poles (N poles) being faced each other toward the center plate P, radiate out of the outer circumference of the center plate P, and flow immediately to the opposite poles (S poles).

Also in the case of the loudspeaker shown in FIG. 8 having the outer ring L and the loudspeaker shown in FIG. 9 without the outer ring L and with the voice coil 1 containing magnetic material F, part of magnetic fluxes radiated from the outer circumference of the center plate P immediately flows to the opposite poles (S poles), and most of the magnetic fluxes pass through the outer ring L or the magnetic material F and flow to the opposite poles (S poles).

Therefore, the magnetic flux distribution of the magnetic circuit becomes as shown in FIG. 11. Specifically, the quantity of fluxes is large near at the center plate P, and it reduces at the positions upper and lower than the center of the center plate P. The quantity of fluxes becomes zero near at the position about $\frac{1}{3}$ to $\frac{1}{2}$ the width of each magnet. At the positions upper and lower than the zero points, the flow of fluxes becomes opposite to that near the center plate P. The quantity of negative fluxes increases and becomes maximum at the top and bottom of the magnets M1 and M2. At the positions upper and lower than the maximum points, the quantity of fluxes converge to zero. In other words, although fluxes sufficient for driving the voice coil 1 are generated near at the center of the center plate P, at the positions upper and lower than the center plate P, negative fluxes are generated which suppress the normal operation of the voice coil 1.

A loudspeaker using a magnetic circuit with a repulsion magnetic field becomes sufficient for practical use if the winding width of a voice coil is set within a predetermined range. However, obviously, it is more preferable if a magnetic circuit has no negative flux. A conventional repulsion magnetic circuit is very difficult to eliminate negative magnetic fluxes.

SUMMARY OF THE INVENTION

It is an object of the present invention to solve the above-described conventional problems and provide an improved loudspeaker having a repulsion magnetic circuit capable of eliminating negative fluxes.

In order to achieve the above object, according to one aspect of the present invention, there is provided a loudspeaker having two magnets with the same poles being faced each other and a voice coil disposed in a repulsion magnetic field generated by the counter magnets, wherein an outer magnet magnetized in a direction different from the counter magnets is disposed outside of the counter magnets.

In this case, the magnets are made to have a cylindrical shape or a tubular shape and are magnetized in the thickness direction, and the outer magnet is made to have a cylindrical shape or a tubular shape and magnetized in a radial direction. Alternatively, the outer magnet is formed by radially divided tubular pieces and magnetized by parallel lines of magnetic force flowing from the outer wall to the inner wall of the outer magnet.

According to another aspect of the present invention, there is provided a loudspeaker having a magnet magnetized in a radial direction from the inner wall to the outer wall of the magnet and a voice coil containing magnetic material disposed outside of the magnet spaced apart by a predetermined clearance.

According to another aspect of the present invention, there is provided a loudspeaker having a magnet assembled by magnet pieces magnetized in a predetermined direction and arranged to have the same magnetization direction and a voice coil containing magnetic material disposed outside of the magnet spaced apart by a predetermined clearance.

With the loudspeaker constructed as above, negative magnetic fluxes are not generated at the positions upper and lower than the position approximately 1/3 to 1/2 the thickness of the magnets, as opposed to the conventional repulsion magnetic circuits.

BRIEF DESCRIPTION OF THE DRAWINGS

FIG. 7 is a plan view and a cross sectional view showing the structure of a magnetic circuit of a loudspeaker according to another embodiment of the present invention.

DETAILED DESCRIPTION OF THE PREFERRED EMBODIMENTS

Figure 8A:
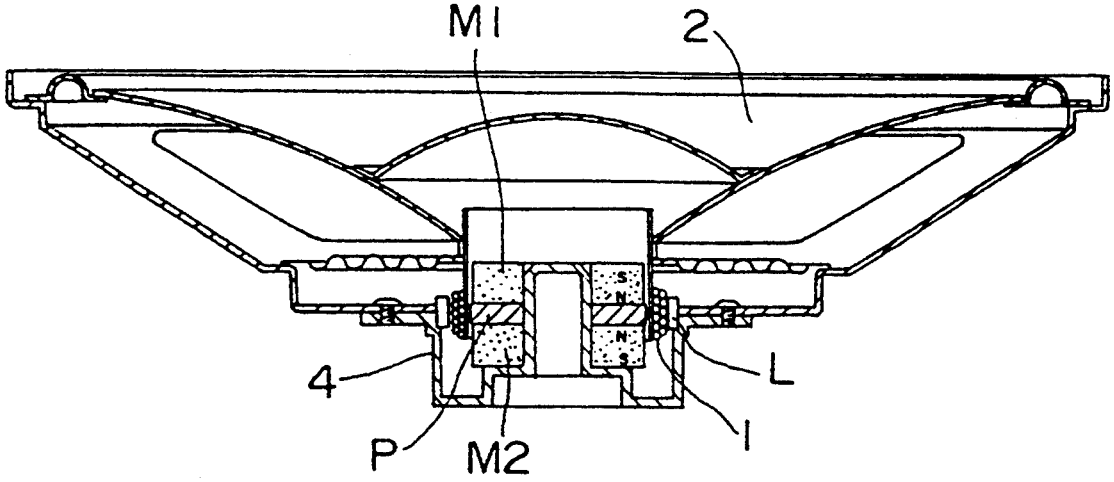
FIG. 8A PRIOR ART
FIG. 8 is a cross sectional view of a loudspeaker with a conventional repulsion magnetic circuit proposed by the present inventors, and a broken perspective view illustrating assembly of the magnetic circuit.
Figure 8B:
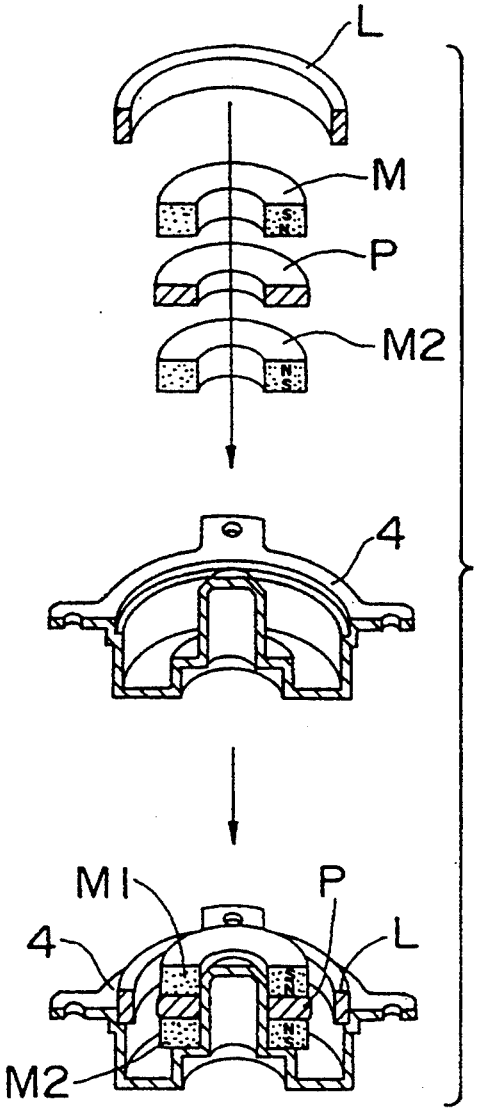
FIG. 8B PRIOR ART
Figure 9A:
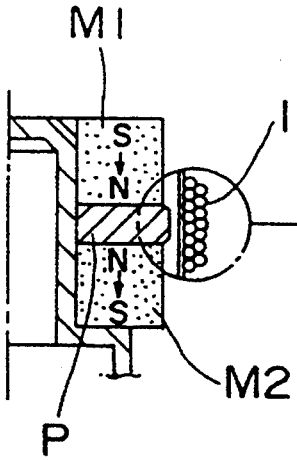
FIG. 9A PRIOR ART
FIG. 9 is a cross sectional view and an enlarged view showing the main part of a loudspeaker with a conventional repulsion magnetic circuit proposed by the present inventors.
Figure 9B:
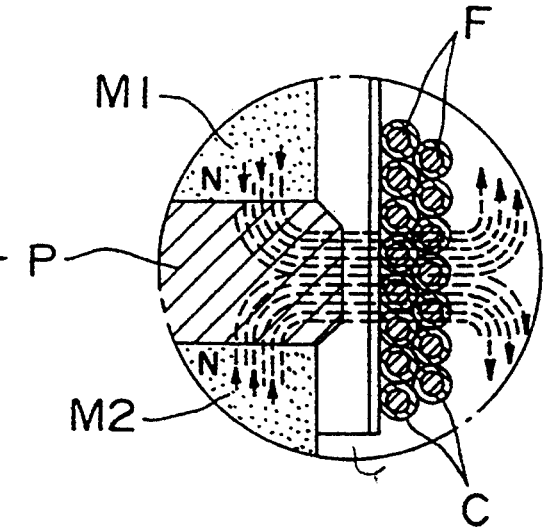
FIG. 9B PRIOR ART
Figure 10A:
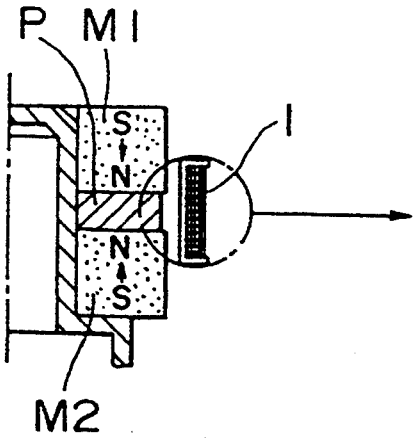
FIG. 10A PRIOR ART
FIG. 10 is a cross sectional view and an enlarged partial view showing the main part of a loudspeaker with a conventional repulsion magnetic circuit.
Figure 10B:
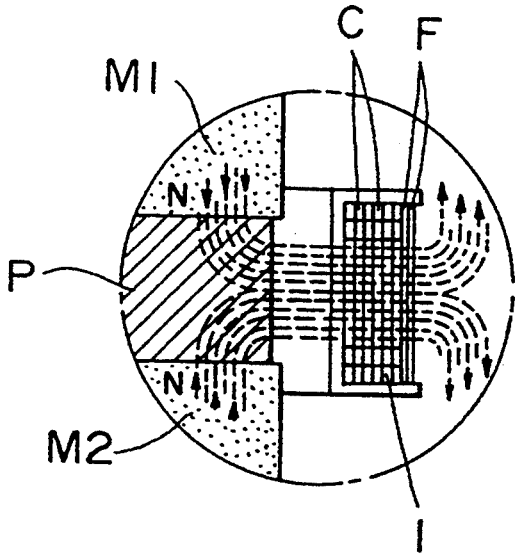
FIG. 10B PRIOR ART
Figure 11A:
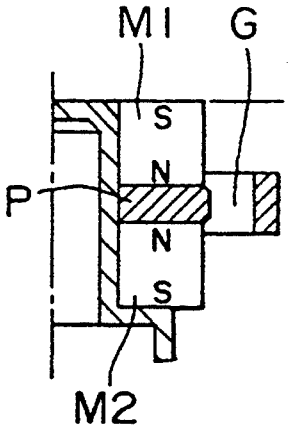
FIG. 11A PRIOR ART
FIG. 11 is a cross sectional view of a magnetic circuit with a conventional repulsion magnetic circuit proposed by the present inventors and a magnetic flux distribution diagram.
Figure 11B:
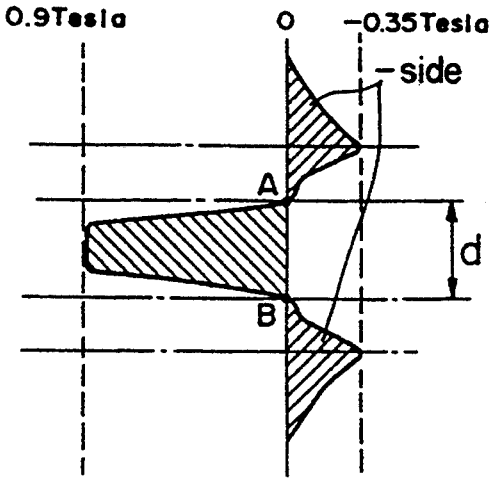
FIG. 11B PRIOR ART
Figure 12:
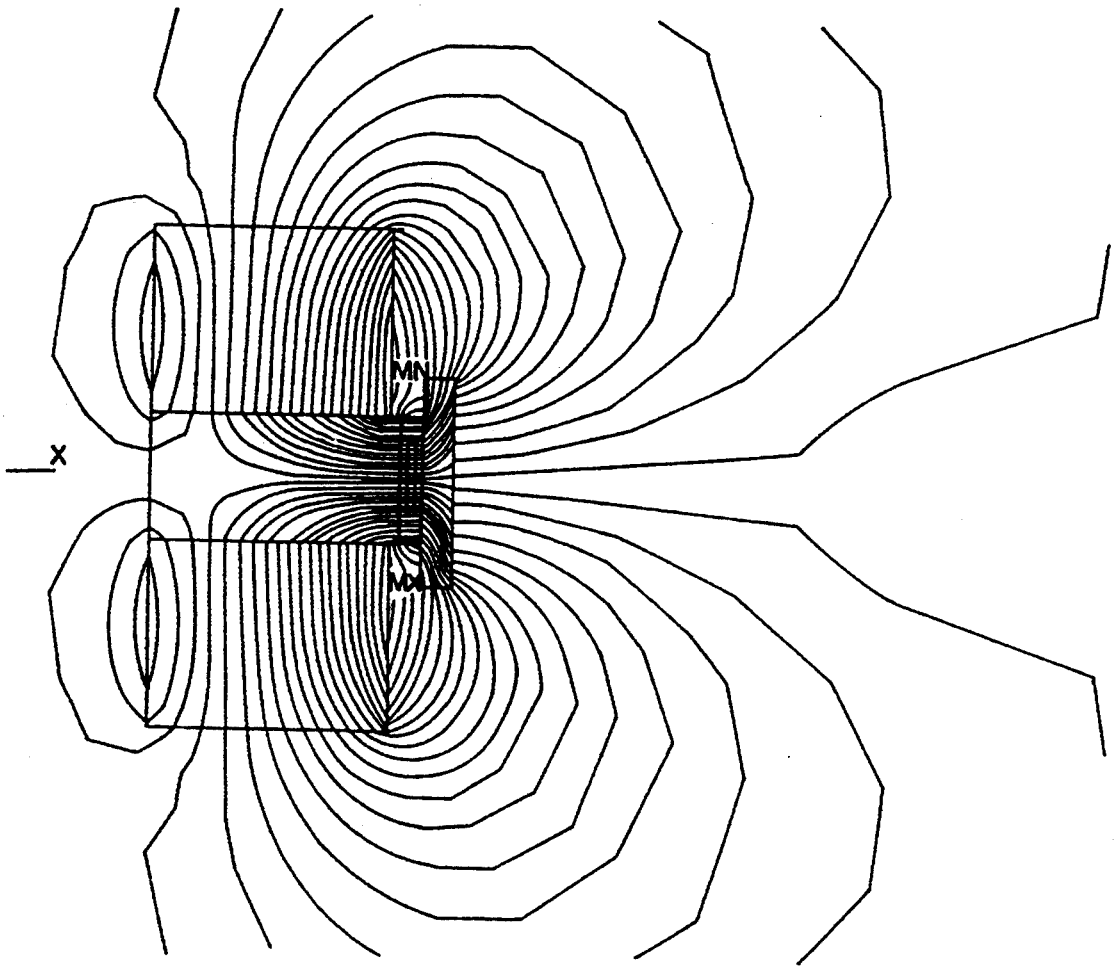
FIG. 12 PRIOR ART
FIG. 12 is a magnetic flux distribution diagram obtained through magnetic field analysis of a conventional repulsion magnetic circuit of a loudspeaker proposed by the present inventors.

Embodiments of the loudspeaker according to the present invention will be described with reference to FIGS. 1 to 7. Like elements to those described with FIGS. 8 to 10 are represented by identical reference numerals and characters, and the description thereof is omitted.

Neodymium magnets are worked into ring magnets M1 and M2 having an outer diameter of 29 mm, an inner diameter of 12 mm, and a thickness of 9 mm, and magnetized in the thickness direction. The same poles, N poles in this embodiment, of the magnets M1 and M2 are faced each other, and a center plate P is sandwiched between the magnets and adhered to them by adhesive agent by aligning together the center points of the inner diameters M11 and M21 of the magnets and the inner diameter P1 of the center plate P. The center plate P has an outer diameter of 4 mm, an inner diameter of 11.9 mm, and a thickness of 6 mm.

A neodymium magnet is worked into a tube having an inner diameter of 29 mm, an outer diameter of 34 mm, and a thickness of 9 mm. This tube is radially cut into six outer magnets M3 each having an internal angle of 60 degrees, an inner radius 14.5 mm, an outer radius of 17 mm (2.5 mm wall width), and a thickness of 9 mm. Each outer magnet M3 is magnetized in the arrow direction shown in FIG. 1, i.e., in the radial direction from the circle center to the outer circumference.

Figure 1A:
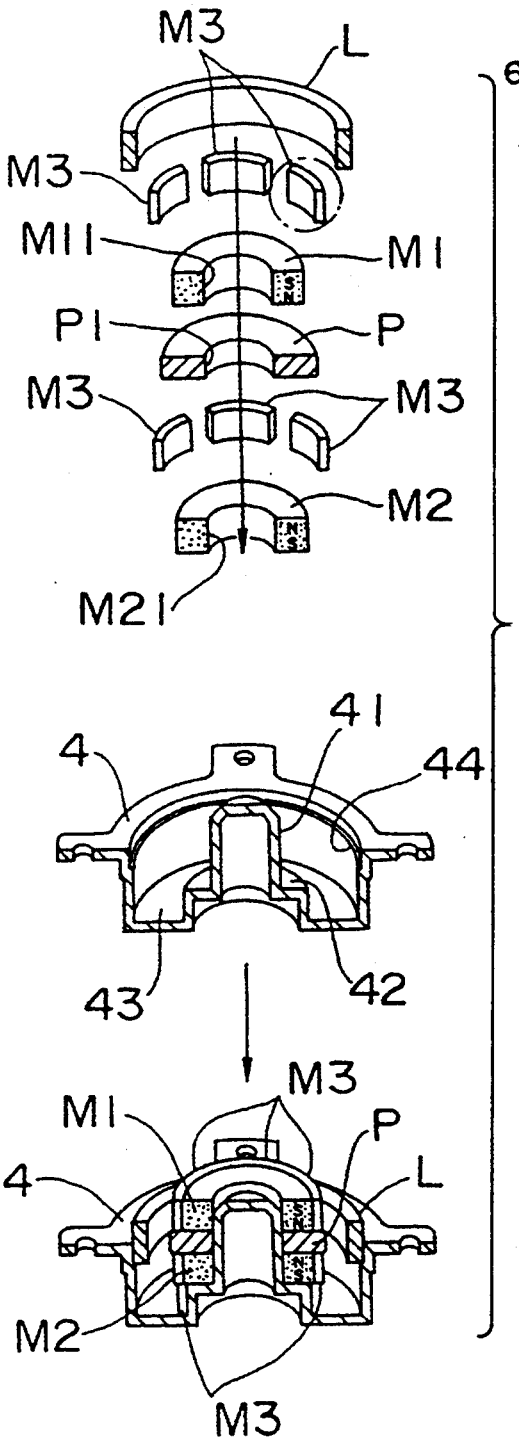
FIG. 1 is a broken perspective view illustrating assembly of a magnetic circuit used by a loudspeaker of the present invention.
Figure 1B:
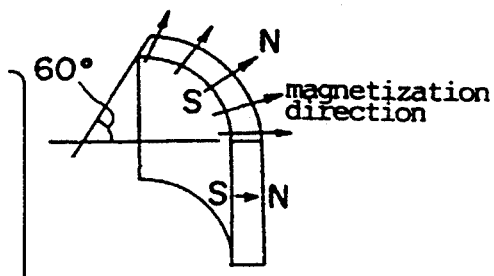
Figure 2A:
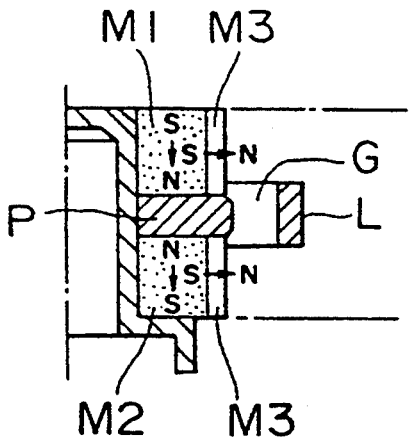
FIG. 2 is a cross sectional view showing the main part of the magnetic circuit and a magnetic flux distribution diagram.
Figure 2B:
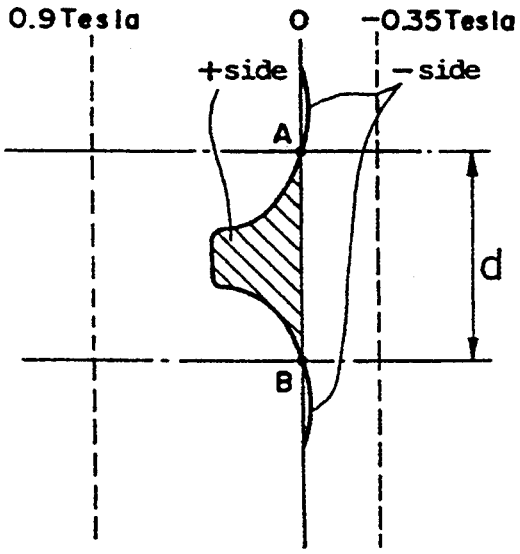

The inner walls of the outer magnets M3 are securely adhered to the outer walls of the magnets M1 and M2 by adhesive agent, at radially divided six positions. An aluminum holder 4 shown in FIGS. 1 and 2 is used for holding the counter magnets M1 and M2, center plate P, and outer ring L.

A tubular center guide 41 is formed extending upward from the center of the bottom 43 of the holder 4. A step 42 is formed at the lower area of the center guide 41 for the vertical positioning of the counter magnets. After acrylic adhesive agent is coated onto the step 42, the inner diameter portion M21 of the magnet M2 is fitted around the center guide 41. The center plate P and magnet M1 are also fitted around the center guide 41. Since the outer diameter of the center guide 41 of the holder 4 is worked to 11.88 mm, the inner diameter portions M11 and M21 of the magnets M1 and M2 and the inner diameter portion P1 of the center plate P can be easily fitted around the center guide 41. The outer ring L made of iron and having an inner diameter of 37.5 mm, an outer diameter of 41 mm, and a height of 12 mm is forcibly fitted on a step 44 formed on the inner wall of the flange of the holder 4. In this manner, as shown in FIG. 2, a magnetic circuit having a magnetic gap G of about 1.5 mm at the outer periphery of the center plate P is manufactured.

The magnetic flux distribution of this magnetic circuit was measured. As shown in FIG. 2, the quantity of magnetic fluxes became smaller in the magnetic gap G than the conventional magnetic circuit proposed by the present inventors. However, magnetic fluxes in the magnetic gap may be increased to the degree sufficient for practical use, by using a magnet having a higher energy product or by changing the shape and mount position. The magnetic flux distribution of this magnetic circuit was different at the upper and lower positions than the center of the center plate P from conventional magnetic circuits proposed by the present inventors and other inventors. Specifically, as shown in FIG. 2, the quantity of magnetic fluxes became zero near at the top and bottom of the outer magnets M3, and at the upper and lower positions than the top and bottom of the outer magnets, the magnetic flux density became almost zero although the flow of magnetic fluxes became opposite to that near at the center plate P. The negative magnetic fluxes increased slightly at the upper and lower positions, and then converged to zero. The diagram of lines of magnetic force shown in FIG. 3 obtained through magnetic field computer analysis of the magnetic circuit.

As described previously, in the magnetic flux distribution diagram of the repulsion magnetic circuits proposed by the present inventors and other inventors, the quantity of fluxes becomes zero near at the positions about $\frac{1}{3}$ to $\frac{1}{2}$ the width of the counter magnets M1 and M2. At the positions upper and lower than the zero points, negative magnetic fluxes increase and become maximum at the top and bottom of the magnets M1 and M2.

Figure 3:
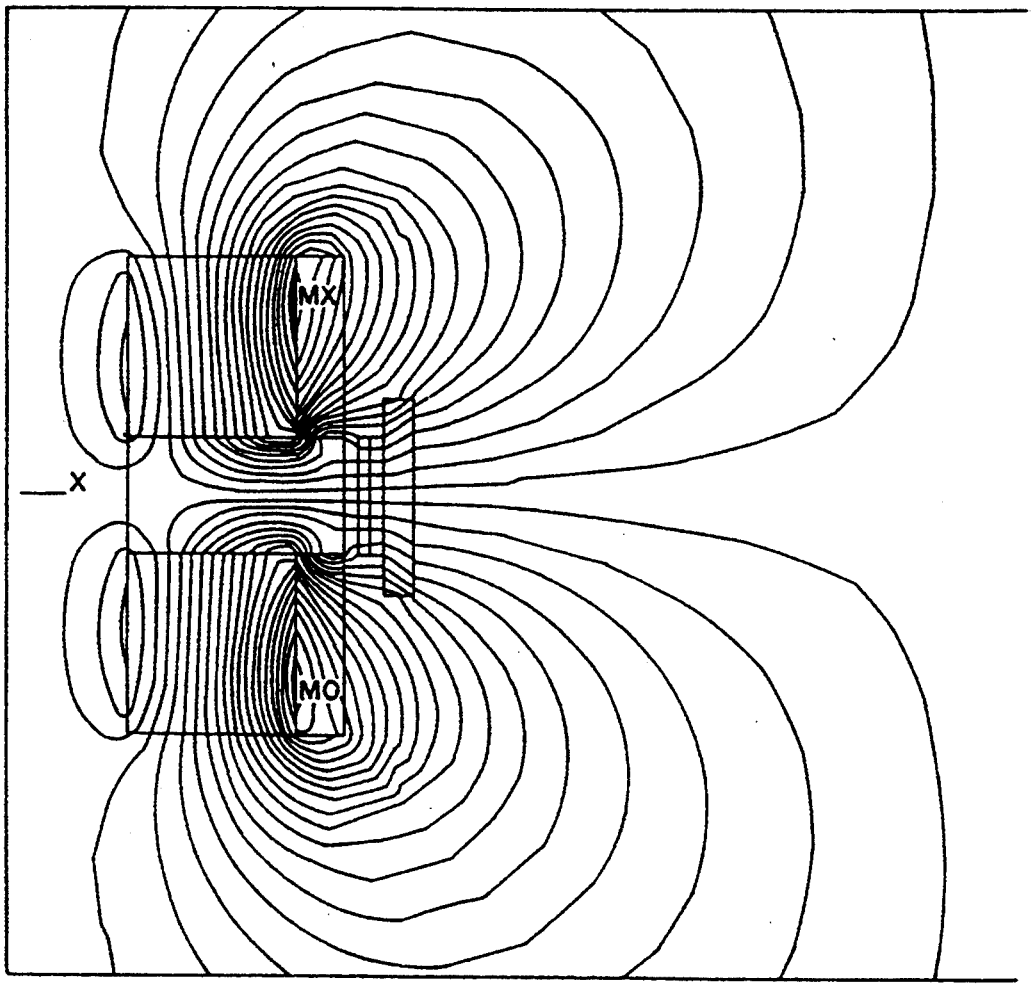
FIG. 3 is a diagram showing lines of magnetic force obtained through magnetic field analysis of the magnetic circuit.

As compared to the conventional magnetic flux distribution, in the embodiment magnetic circuit having the magnetic field analyzed as shown in FIG. 3, magnetic fluxes radiated from the counter magnets M1 and M2 to the outer circumference of the center plate P are moved upward or downward by the magnetic filed generated by the outer magnets M3, without immediately flowing toward the opposite S poles. That is to say, the magnetic flux zero points move upward and downward far greater than the conventional magnetic circuits proposed by the present inventors and other inventors, i.e., the width d between the magnetic flux zero point A and magnetic flux zero point B expands to the top and bottom of the outer magnets M3. As a result, negative magnetic fluxes are not generated in this width as opposed to the magnetic circuits proposed by the present inventors.

Figure 4A:
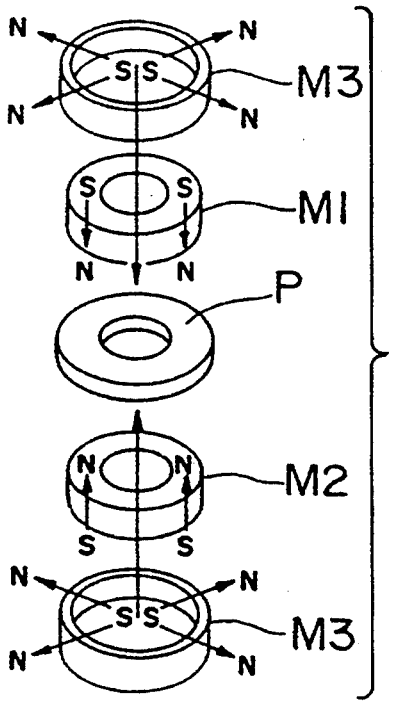
FIG. 4 is a broken perspective view using a tubular type outer magnet.
Figure 4B:
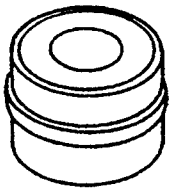
Figures 5A, 5B:
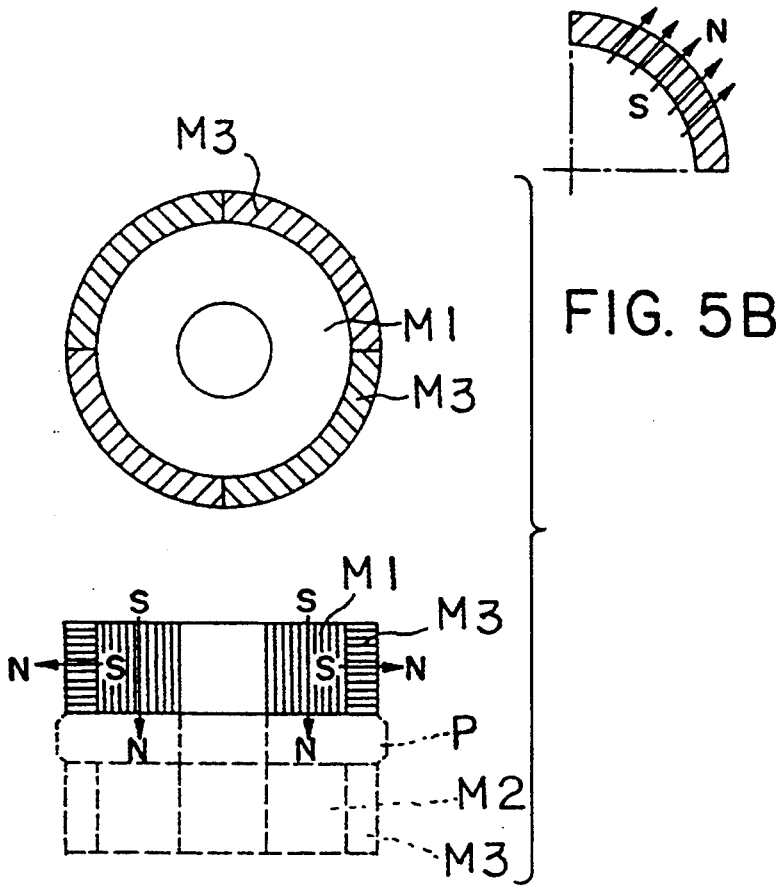
FIG. 5 is a plan view and a side view showing another example of outer magnets.

In this embodiment, the radially divided outer magnets M3 are used. As the outer magnets, an integral tubular type magnet such as shown in FIG. 4 may also be used. The outer magnets M3 may be divided as desired, such as outer magnets radially divided by four shown in FIG. 5. The outer magnets M3 may be magnetized in an ordinary manner, namely, magnetized by parallel lines of magnetic force directing from the inner wall to the outer wall of the magnets M3, and adhered to the outer walls of the counter magnets M1 and M2, providing similar advantageous effects.

Figure 6A:
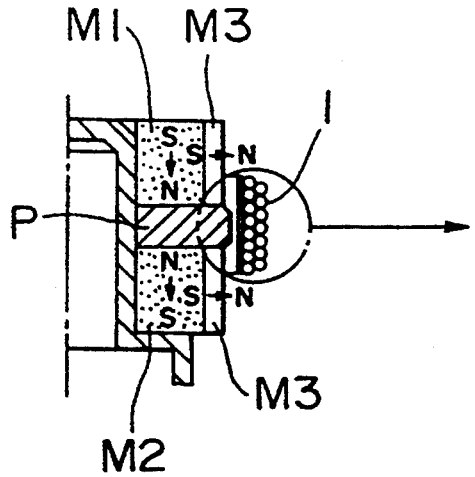
FIG. 6 is a cross sectional view and an enlarged partial view of a magnetic circuit and a voice coil of a loudspeaker according to another embodiment of the present invention.
Figure 6B:
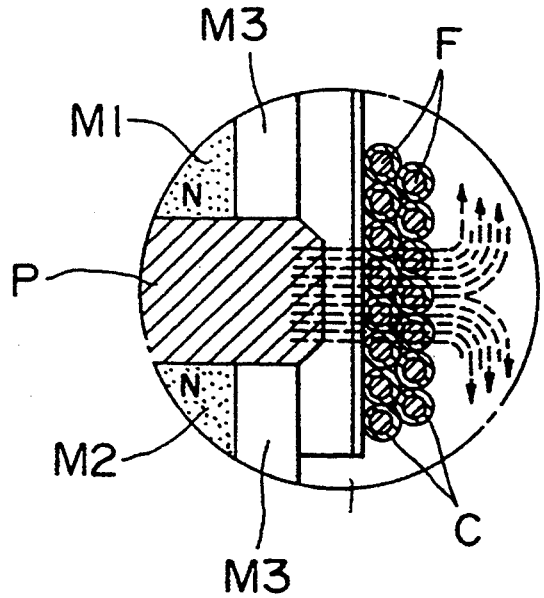

In this embodiment, the outer ring L is disposed to form the magnetic gap. Instead of using the outer ring L, a voice coil 1 containing magnetic material F may be used, providing similar advantageous effects. For example, as shown in FIG. 6, a voice coil 1 may be formed by a voice coil having a core made of soft magnetic material F such as iron and a surface layer made of conductive material C such as copper melted and adhered to the surface of the core, and the voice coil 1 is disposed near at the center plate P spaced apart by a predetermined clearance, providing similar advantageous effects. Alternatively, a voice coil may be used which has a core made of conductive material such as copper and aluminum and a surface layer made of soft magnetic material F such as iron and Permalloy adhered to the surface of the core by means of plating or vapor deposition.

Without using the counter magnets, only the outer magnets M3 may be used. For example, as shown in FIG. 7A, an integral cylindrical or tubular magnet, or a cylindrical or tubular magnet M4 formed by coupling radially divided magnet pieces may be used which is magnetized in the radial direction, and a voice coil 1 containing magnetic material F is disposed near at the magnet M4 spaced apart by a predetermined clearance as shown in FIG. 6.

Magnet pieces divided into a desired number of pieces, for example, four magnet pieces such as shown in FIG. 7B, may be magnetized in an ordinary manner, namely, magnetized by parallel lines of magnetic force directing from the inner wall to the outer wall of the magnet pieces. The magnetized magnet pieces are assembled to a tubular magnet M5, and a voice coil 1 containing magnetic material F is disposed near at the magnet M5 spaced apart by a predetermined clearance as shown in FIG. 6, thus providing similar advantageous effects.

In the embodiment, the shape of the magnetic circuit and voice coil 1 is circular. Other shapes such as ellipsoid and polygon may also be used.

According to the loudspeaker of the present invention, negative magnetic fluxes are not generated at the positions upper and lower than the position approximately $\frac{1}{3}$ to $\frac{1}{2}$ the thickness of the magnets, as opposed to the conventional magnetic circuits proposed by the present inventors. As a result, there is no constraint in a winding width of a voice coil, an amplitude and compliance of a vibrating system, and the like, thereby considerably improving the degree of design freedom. It is therefore possible to easily manufacture a high performance loudspeaker suitable for particular applications.

What is claimed is:

1. A moving coil type loudspeaker having two counter magnets with similar poles facing each other and a voice coil disposed in a repulsion magnetic field generated by the counter magnets, wherein an outer magnet magnetized in a direction different from said counter magnets is disposed outside of said counter magnets and wherein said outer magnet is formed by radially divided tubular pieces and magnetized by parallel lines of magnetic force flowing from an outer wall of said outer magnet to an inner wall of said outer magnet.

2. A loudspeaker according to claim 1 further comprising an outer ring (L) of magnetic material which is disposed coaxially with said first and second counter magnets and in an identical plane with the center plate.

3. A moving coil type loudspeaker including a magnetic circuit for generating a repulsive magnetic field and a voice coil disposed in the magnetic field, wherein said magnetic circuit comprises first and second counter magnets (M1, M2) coaxially aligned with each other and being interposed by a center plate (p) and first and second outer magnets (M3) respectively disposed onto the outer surfaces of said first and second counter magnets, both of said first and second counter magnets being axially magnetized and both of said first and second outer magnets being magnetized in a non-axial direction so that the magnetic flux radial component of the repulsive magnetic field in the vicinity of the outer surface of said magnetic circuit, where said voice coil is positioned, is in one polarity over the axial width of said first and second counter magnets.

4. A loudspeaker according to claim 3 wherein said voice coil comprises a conductive material layer (C) and a magnetic material layer (F).

* * * * *